US010468175B2

(12) United States Patent
Suzuki et al.

(10) Patent No.: US 10,468,175 B2
(45) Date of Patent: Nov. 5, 2019

(54) REACTOR AND METHOD OF MANUFACTURING THEREOF

(71) Applicant: TAMURA CORPORATION, Tokyo (JP)

(72) Inventors: Kotaro Suzuki, Sakado (JP); Tsutomu Hamada, Sakado (JP)

(73) Assignee: TAMURA CORPORATION, Tokyo (JP)

( * ) Notice: Subject to any disclaimer, the term of this patent is extended or adjusted under 35 U.S.C. 154(b) by 164 days.

(21) Appl. No.: 15/697,319

(22) Filed: Sep. 6, 2017

(65) Prior Publication Data

US 2018/0075964 A1 Mar. 15, 2018

(30) Foreign Application Priority Data

Sep. 9, 2016 (JP) ..... 2016-176987

(51) Int. Cl.

| | |
|---|---|
| ***H01F 27/22*** | (2006.01) |
| ***H01F 27/26*** | (2006.01) |
| ***H01F 27/30*** | (2006.01) |
| ***H01F 41/04*** | (2006.01) |
| ***H01F 27/32*** | (2006.01) |
| *H01F 27/28* | (2006.01) |

(52) U.S. Cl.

CPC ..... *H01F 27/266* (2013.01); *H01F 27/22* (2013.01); *H01F 27/263* (2013.01); *H01F 27/306* (2013.01); *H01F 27/327* (2013.01); *H01F 41/04* (2013.01); *H01F 27/2823* (2013.01); *H01F 27/324* (2013.01)

(58) Field of Classification Search

CPC ..... H01F 27/00–36

USPC ..... 336/65, 83, 90, 92, 96, 196, 198, 200, 336/206–208, 220–223, 212, 232–234

See application file for complete search history.

(56) References Cited

U.S. PATENT DOCUMENTS

| | | | | |
|---|---|---|---|---|
| 3,167,732 A * | 1/1965 | Novak | H01F 27/022 336/205 |
| 2015/0130576 A1* | 5/2015 | Suzuki | H01F 27/00 336/92 |
| 2018/0190421 A1* | 7/2018 | Yoshikawa | H01F 27/025 |

FOREIGN PATENT DOCUMENTS

| | | |
|---|---|---|
| JP | 2013-26420 A | 2/2013 |
| JP | 5274208 B2 | 5/2013 |
| JP | 5465151 B2 | 1/2014 |
| JP | 2018098300 A * | 6/2018 |

* cited by examiner

*Primary Examiner* — Tuyen T Nguyen

(74) *Attorney, Agent, or Firm* — Nath, Goldberg & Meyer; Jerald L. Meyer; Stanley N. Protigal

(57) ABSTRACT

An annular core includes an upper core and a lower core. A coil is attached to the leg of the annular core in a way that the winding axis is aligned in the vertical direction. The surface of the upper core is covered by an upper cover formed of resin. The surface of the lower core is covered by the lower cover formed of resin. A casing formed of metal includes a bottom plate having an opening, and a side wall integrated with the bottom plate, and the lower core, the coil, and the upper core are housed in the casing. A part of the lower cover is exposed via the opening of the casing. A filler resin is filled in a gap between the circumference of the annular core and the coil, and the side wall of the casing or the lower cover.

12 Claims, 21 Drawing Sheets

REACTOR AND METHOD OF MANUFACTURING THEREOF

CROSS-REFERENCE TO RELATED APPLICATION

This application is based upon and claims the benefit of priority from Japan Patent Application No. 2016-176987, filed on Sep. 9, 2016, the entire contents of which are incorporated herein by reference.

FIELD OF THE INVENTION

The present disclosure relates to a reactor having a reactor main body housed in a metal casing, and a method of manufacturing the reactor.

BACKGROUND

For example, as reactors applied for a vehicular booster circuit, a reactor which have a resin mold component covering the circumference of an annular magnetic core, and which have a coil around the outer circumference of the resin mold component is known.

Conventionally, according to this type of reactors, as described in JP 2013-026420 A, JP 5274208 B. and JP 5465151 B, the; entire reactor is housed in a metal casing formed of aluminum, etc., and a filler is injected and solidified between the reactor and the casing. When fastening the reactor employing such a structure to an attaching position such as a vehicle body, the casing is fastened to the attaching site by means of, for example, screws.

However, according to the above conventional technologies, a resin is applied and solidified around the circumference of a core set in a mold to integrate the core and the resin molding with each other, and then the integrated core and resin molding are set in the casing. Hence, at the time of assembling of the reactor, a work to fasten both the core and the resin molding set in the casing so as not to move within the casing is necessary, and there is a disadvantage such that the number of manufacturing steps of the reactor increases.

The conventional casing is a box shape having an opened upper surface, and therefore leakage magnetic fluxes generated by the coil housed in the casing traverse the bottom of the casing. Aluminum that has excellent heat dissipation is often used for the metal casing. However, according to the conventional casings, since the side surface of the casing is placed so as to face the yoke portion of the core, the inductance decreases due to the shielding effect against the magnetic fluxes leaking from the back surface of the core.

SUMMARY OF THE INVENTION

The present disclosure has been proposed in order to address the technical problems of the above conventional technologies. An objective of the present disclosure is to provide a reactor which has a little assembling step and ensures an appropriate inductance, and a manufacturing method thereof.

In order to achieve the above objective, a reactor and a manufacturing method thereof according to the present disclosure employ the following structure.

(1) an annular core including an upper core and a lower core, and has upper and lower yokes extending in a horizontal direction and a leg extending in a vertical direction;

(2) a coil attached to the leg of the annular core in a way that a winding axis is aligned in a vertical direction;

(3) an upper cover formed of resin and fastened so as to cover at least a part of a surface of the upper core;

(4) a lower cover formed of resin and fastened so as to cover at least a part of a surface of the lower core;

(5) a casing formed of metal, including a bottom plate having an opening, and a side wall provided integrally with the bottom plate, in which the lower core, the coil, and the upper core are housed in the casing, and in which the casing is fastened to the lower cover with the opening covered by a part of the lower cover; and (6) a filler resin filled in a gap between a circumference of the annular core and the coil, and the side wall of the casing or a side wall of the lower cover.

According to the present disclosure, the following structure may be employed.

(1) an opening is provided in the side wall of the casing, a side wall that blocks the opening of the casing is provided on the lower cover, and the filler resin is filled in the gap between the circumference of the annular core and the coil, and the side wall of the casing and the side wall of the lower cover.

(2) a height of the side wall of the casing is higher than an upper surface of the coil housed in the casing, and the filler resin covers the upper surface of the coil.

(3) the casing includes a front wall and a rear wall, the lower cover includes right and left side walls, and a portion surrounded by these walls is a housing space for the upper core and the coil.

(4) the lower cover includes right and left side walls, a front wall, and a rear wall, and a portion surrounded by these walls is a housing space for the upper core and the coil.

(5) the casing is provided with an opening in a part of a wall, and the lower cover covers the opening.

(6) the upper core and the lower core are each formed of an E-shaped core, and the coil is attached to a middle leg of the E-shaped core.

(7) at least one surface of an upper surface, the side wall, the front wall, the rear wall, and the bottom plate is covered by the lower cover.

(8) the upper cover includes a projection located at a gap between the upper cover and the casing.

(9) the casing includes a projection for positioning on a bottom.

(10) the upper core, the lower cover, and the casing are fastened by a screw.

A method of manufacturing a reactor includes the following processes:

setting a lower core in a mold for molding a lower cover;

setting a casing formed of metal and having an opening in a bottom in the mold so as to surround the lower core;

injecting a resin for molding the lower cover into the mold so as to enter a circumference of the upper core and the opening of the casing;

curing the resin to cover the lower core, and to form the lower cover integrated with the lower core and the casing, and having a housing space for the coil and the upper core;

placing, in the housing space of the lower cover, the coil and the upper core covered by the upper cover in sequence; and injecting a filler resin in a gap formed around the coil and the upper core both in the housing space, and solidifying the filler resin.

According to the present disclosure, since the lower core, the lower cover, and the casing are fastened with each other, a fastening work for the casing and the lower core is unnecessary at the time of assembling, and the assembling work of the reactor is simplified. Since the opening is provided in the bottom of the casing formed of metal, and the lower cover is exposed therefrom, the magnetic flux passes through the opening, and a shielding effect by the casing formed of metal can be eliminated. Accordingly, an appropriate inductance can be ensured.

DETAILED DESCRIPTION OF THE EMBODIMENTS

1. First Embodiment

1-1. Structure

A first embodiment according to the present disclosure will be described below in detail with reference to the figures.

Figure 1:
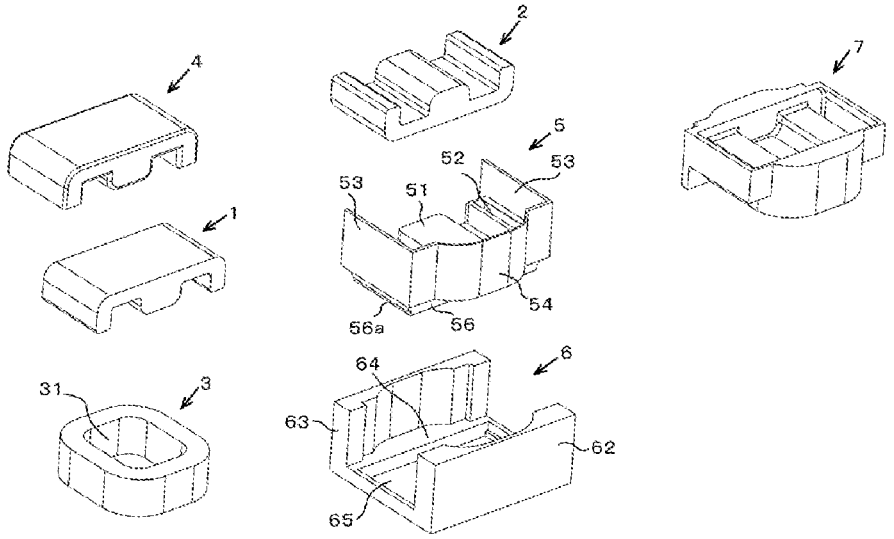
FIG. 1 is an exploded perspective view according to a first embodiment.

In the first embodiment, an annular core includes an upper core 1 having a single yoke extending in the horizon direction and right and left legs and middle legs extending in the vertical direction, and a lower core 2 having the same shape, and combined in the vertical direction. A coil 3 is installed on the middle leg of the upper core 1 and the lower core 2. The coil 3 is manufactured by winding a rectangular wire in an edgewise winding manner, attaching to the middle leg in a way that the winding axis is aligned in the vertical direction. In FIG. 1, although the drawn wire from the coil 3 is omitted, both ends of the conductor forming the coil 3 are drawn out in the vertical direction.

Figure 5:
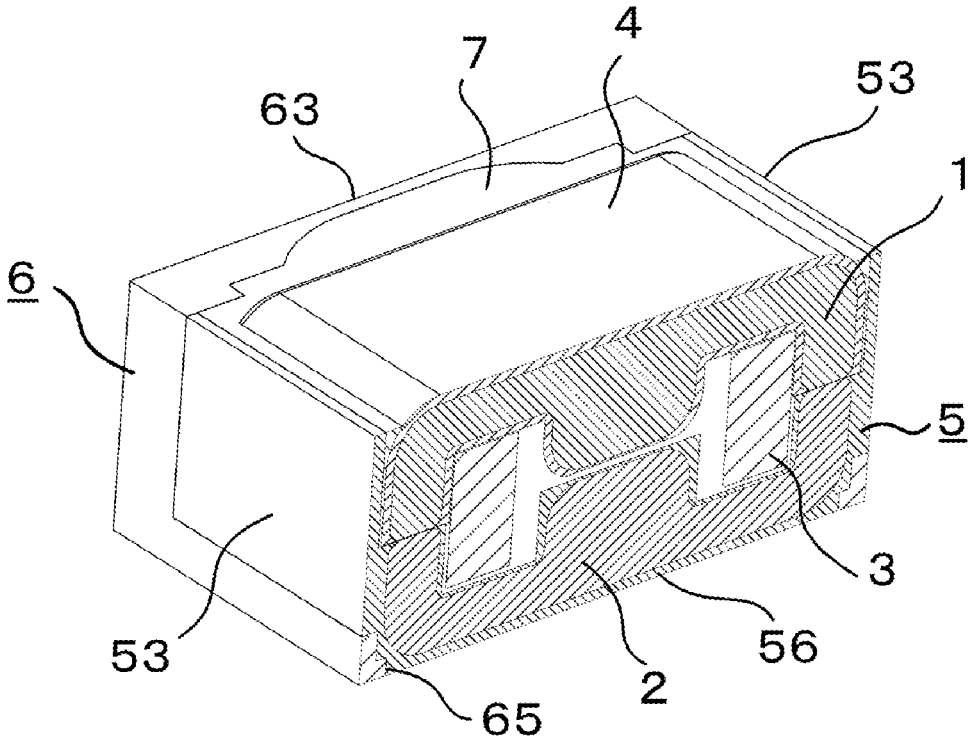
FIG. 5 is a vertical cross-sectional view of the first embodiment viewed from above.
Figure 6:
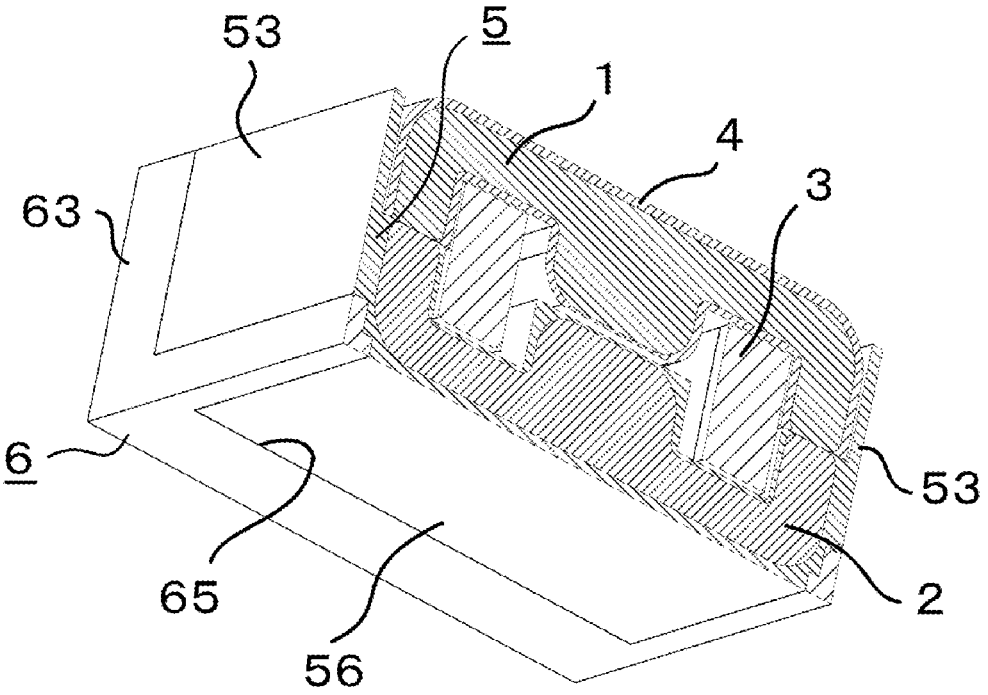
FIG. 6 is a vertical cross-sectional view of the first embodiment viewed from below.

The outer circumference of the upper core 1 is covered by a resin-made upper cover 4, and the outer circumference of the lower core 2 is covered by a resin-made lower cover 5. The upper cover 4 covers the entire circumference of the E-shaped upper core 1, but the lower end surfaces of the right and left legs of the upper core 1 are exposed via an opening 41 provided in the upper cover 4. Similarly, the lower cover 5 covers the entire circumference of the E-shaped lower core 2, but the upper end surfaces of the right and left legs of the lower core 2 are exposed via an opening 52 provided in the lower cover 5. Hence, as illustrated in FIGS. 5 and 6 that are vertical cross-sectional views, the lower end surfaces of the right and left legs of the upper core 1 and the upper end surfaces of the right and left legs of the lower core 2 are in contact with each other to form an annular core. Since the end surface of the middle leg of the upper core 1 is covered by the upper cover 4, and the end surface of the middle leg of the; lower core 2 is covered by the lower cover 5, the middle leg of the upper core 1 and t the middle leg of the lower core 2 abut each other via the upper cover 4 and the lower cover 5.

The lower cover 5 includes an E-shaped core covering portion 51 covering the lower core 2, right and left side walls 53 and a front wall 54 standing upright from the core covering portion 51, and a bottom plate 56 provided on the lower surface of the core covering portion 51. The openings 52 are formed in the upper end surfaces of the right and left legs of the core covering portion 51 to expose the upper end surfaces of the right and left legs of the lower core 2.

The portion surrounded in three directions by the right and left side walls 53 and the front wall 54 is a housing space for the coil 3 and the upper core 1, and the horizontal cross-sect ion of the central portion of the front wall 54 is in an arc shape along the outer circumferential surface of the coil 3. The right and left side walls 53 together with a front wall 62 of a casing 6 and a rear wall 63 thereof define a rectangular frame portion, and the upper edges of the right and left side walls 53 are substantially in the same height with the upper surface of the upper core 1 housed in the casing 6. The upper cover 4 is provided on the outer circumference of the upper core 1, but the heights of the side walls 53 of the lower cover 5 and the front wall 54 are slightly lower than the upper surface of the upper cover 4. Hence, the portion of the upper cover 4 covering the yoke of the upper core 1 is positioned higher than the upper edges of the side walls 53 and the front wall 54.

The bottom plate 56 of the lower cover 5 is integrally molded with a portion of the lower cover 5 covering the lower surface of the yoke. The bottom plate 56 has a size and a shape to tightly fit into the opening 65 provided in the bottom plate 64 of the casing 6, and a step portion 56 a corresponding to the thickness of the casing 6 is provided around the bottom plate 56.

The casing 6 is formed of a metal material like aluminum. The casing 6 has the front wall 62, the rear wall 63, and the bottom plate 64 provided to connect the lower edge of the front wall 62 and the rear wall 63, and the space surrounded by these defines a housing space for the lower cover 5. The inner surface of the front wall 62 and the rear wall 63, that is, the surfaces opposing to the coil 3 are curved in an arc shape along the outer circumference shape of the coil 3. In particular, the inner surface of the front wall 62 a shape that the outer circumferential surface of the front wall 54 of the lower cover 5 to be fastened inside the casing 6 fits tightly. A rectangular opening 65 having a size substantially equal to the planar shape of the lower core 2 is provided in the center portion of the bottom plate 64, and the bottom plate 56 of the lower cover 5 is tightly fitted in this opening 65, As for the right and left side surfaces of the casing 6, the casing 6 itself does not have side walls, and openings are formed. The right and left side walls 53 provided at the lower cover 5 is tightly fitted into this opening.

Figure 4:
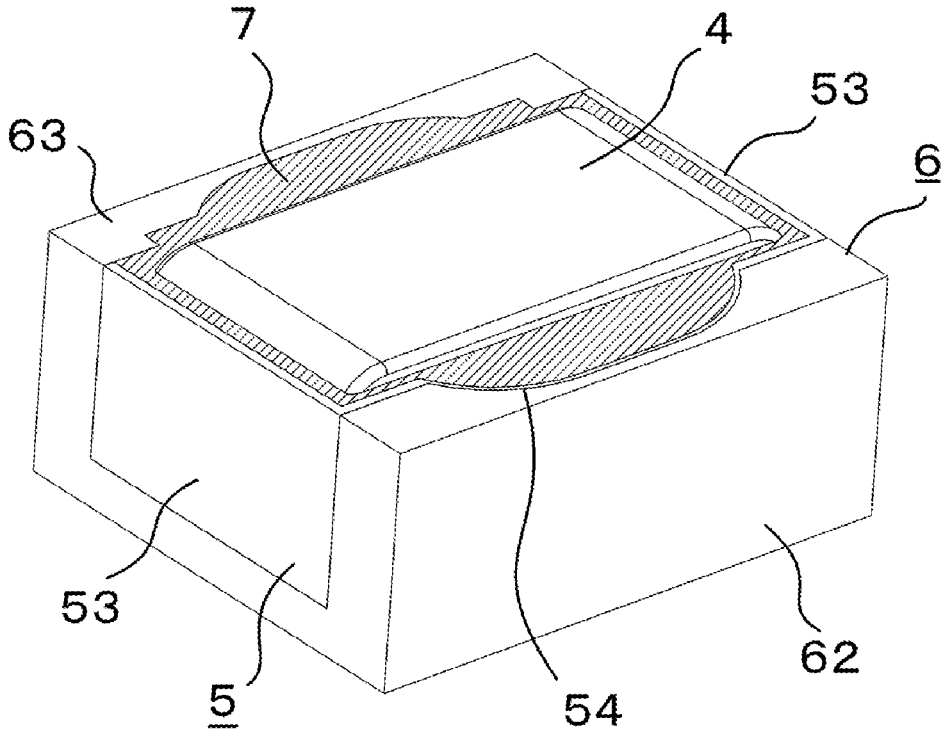
FIG. 4 is a perspective view of a finished state according to the first embodiment.

The gap between the front wall 62 of the casing 6 and the coil 3 and the upper cover 4, the gap between the rear wall 63 of the casing 6 and the coil 3 and the upper cover 4, and the gap between the right and left side walls 53 of the lower cover 5 and the coil 3 and the upper cover 4 are filled with a filler resin 7. FIG. 4 is a perspective view of the reactor in a finished state according to this embodiment. In FIG. 4, the filler resin 7 is a portion indicated by hatching. In the cross-sectional views of FIGS. 5 to 7, the hatching indicates a cross section of the component, but in FIG. 4, the hatching indicates the surface of the filler resin 7.

The upper core 1 and the lower core 2 can be formed of a magnetic material, such as a dust core like pure iron, sendust, Fe—Si alloy, a ferrite core, or a laminated steel plate, but in this embodiment, the dust core is applied. When the upper core 1 and the lower core 2 are bonded to each other, for example, an epoxy-based adhesive, a silicone-based, acryl-based, or polyurethane-based adhesive, or a mixed adhesive of two or more of those are applicable.

The upper cover 4 and the lower cover 5 both formed of resin are formed of heat resistant material having resistant temperature higher than the adhesion temperature of the self-adhesive layer like a PPS (polyphenylene sulfide) resin. For example, as for other adhesives, saturated polyester-based resin, a urethane resin, an epoxy resin, BMC (bulk molding compound), and PBT (polybutylene terephthalate), etc. are also applicable as long as it has the heat resistance.

As for the filler resin 7, a material having a relatively high thermal conductivity, such as urethane, epoxy, and silicone resin, is preferable, and there is an advantage that the heat generated by the coil 3 can be promptly dissipated to the casing 6.

1-2. Reactor Manufacturing Method

A method of manufacturing the reactor according to the first embodiment will be described.

First, as for molding the lower cover 5 by resin, the lower core 2 and the casing 6 are set in a mold for molding the lower cover 5, and the resin for molding the lower cover 5 is injected and solidified around the lower core and the casing, so that the lower core 2, the lower cover 5, and the casing 6 are integrally fastened with each other by an insert molding scheme. Likewise, by setting the upper core 1 in the mold for molding the upper cover 4, and injecting and solidifying the resin around the upper core 1, the upper core 1 and the upper cover 4 are integrally fastened with each other by the insert molding scheme.

Figure 2:
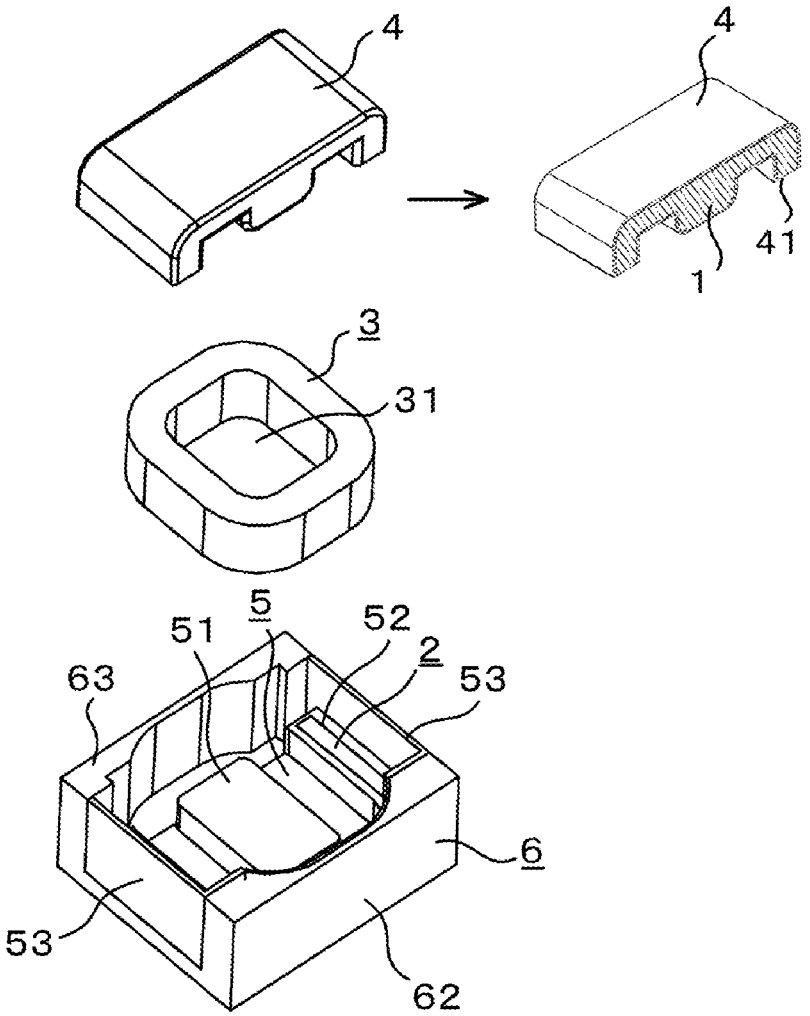
FIG. 2 is an exploded perspective view illustrating a state during the manufacturing according to the first embodiment.
Figure 7:
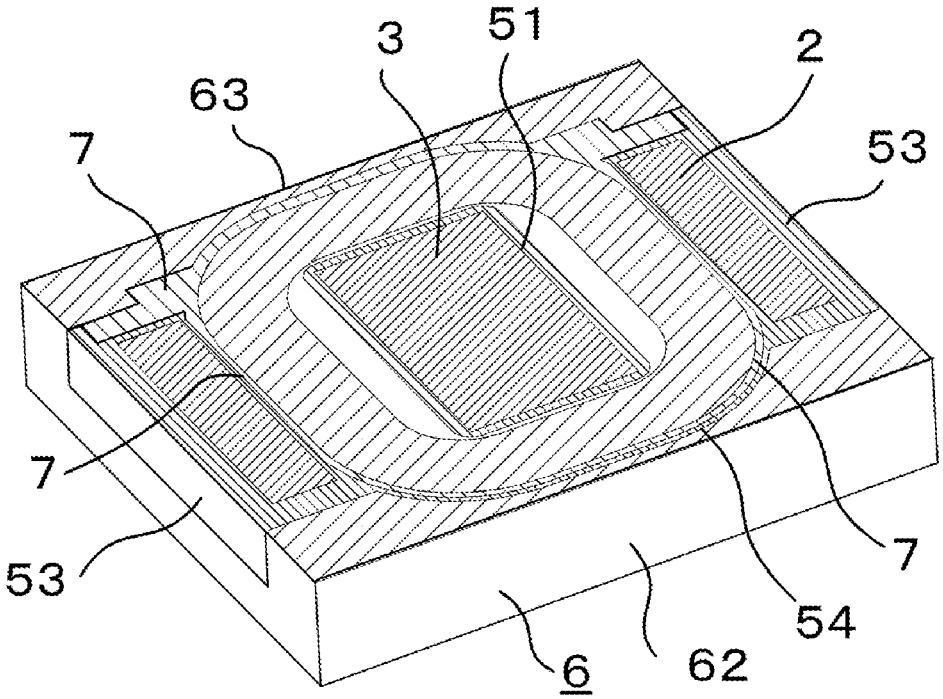
FIG. 7 is a horizontal cross-sectional view of the first embodiment.

As illustrated in FIGS. 2 and 7, the lower core 2, the lower cover 5, and the casing 6 manufactured in this manner have the lower core 2 covered by the lower cover 5, the right and left side walls 53 of the lower cover 5 and the front wall 62 and the rear wall 63 of the casing 6 forming a rectangular frame, and a housing space for the upper core 1 and the coil 3 is formed inwardly relative to the rectangular frame. As illustrated in FIGS. 5 and 6, the opening 65 formed in the bottom plate 64 of the casing 6 is closed by the bottom plate 56 of the lower cover 5 formed inwardly relative to the casing 6, and the resin forming the; bottom plate 56 of the lower cover 5 is exposed via the opening 65 of the casing 6 formed of metal.

Next, the coil 3 is inserted into the housing space formed by the lower cover 5 and the casing 6 from above, and the middle leg of the lower core 2 is fitted into the opening 31 provided inwardly relative to the coil 3. At this time, the distance between the right and left legs of the lower core 2 is designed to be substantially equal to the horizontal dimension of the coil 3, and the coil 3 is positioned by the right and left middle legs. The middle leg of the lower core 2 is smaller than the opening 31 of the coil 3, and a space into which the filler resin 7 enters is formed between the opening 31 and the middle leg.

Figure 3:
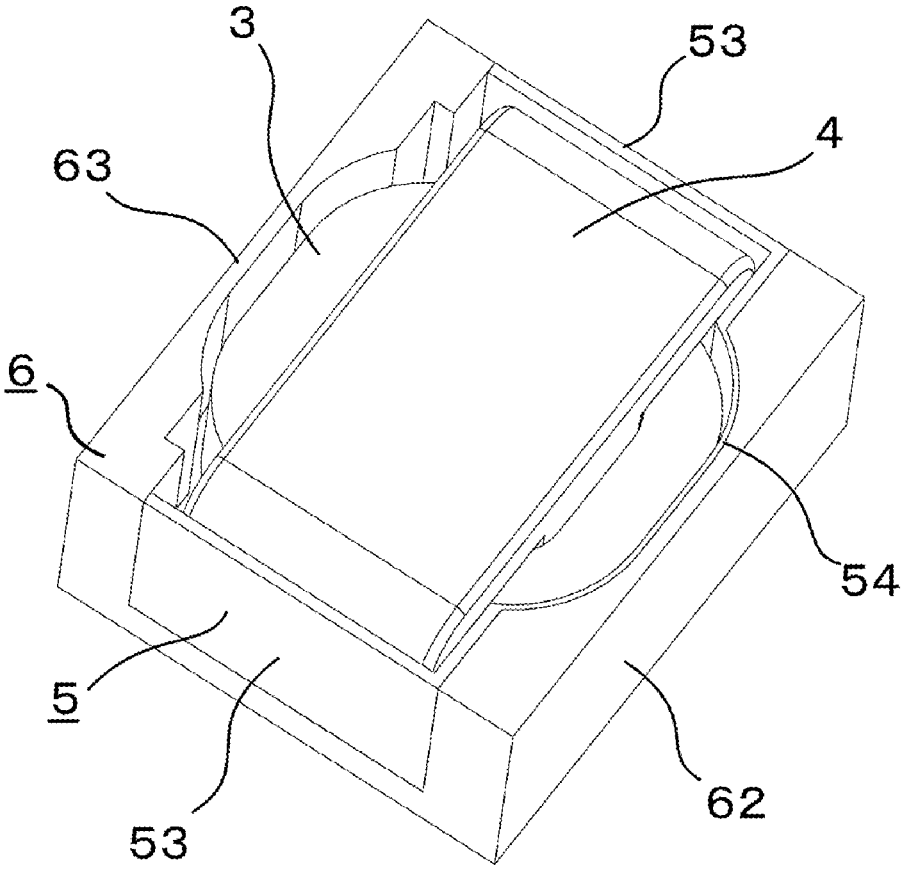
FIG. 3 is a perspective view illustrating a state before a filler resin is filled according to the first embodiment.

After inserting the coil 3, the upper core 1 to which the upper cover 4 is fastened is placed in the housing space by laying over on the coil 3. In this case, lower ends of the right and left legs and the middle leg of the upper core 1 face the upper ends of the right and left legs and the middle leg of the lower core 2 respectively, and the middle leg of the upper core 1 is inserted in the opening 31 inward the coil 3. The upper cover 4 and the upper core 1 are fastened by fixing the respective right and left end faces of the upper core 1 and the lower core 2, that is, the end faces exposed via the openings 41 and 52 by an adhesive, but like a second embodiment, through-holes and screw-holes may be provided in the upper cover 4 and the lower cover 5, and fastening may be achieved by screw without applying an adhesive. As illustrated in FIG. 3, with the coil 3 and the upper core 1 being placed in the housing space, a gap is formed between the circumference of the coil 3 and of the upper core 1, and the side wall 53 and front wall 54 of the lower cover 5 and the rear wall 63 of the casing 6.

In this state, as illustrated in FIG. 4, the filler resin 7 is injected into the gap around the coil 3 and the upper core 1 and solidified, thereby finishing the reactor of this embodiment.

1-3. Manufacturing Method of Lower Cover 5

The reactor of this embodiment is manufactured as described above, but in particular, a method of performing insert molding on the lower core 2 and the casing 6 in the lower cover 5 formed of resin will be described in detail with reference to FIGS. 8 to 10.

Figure 8:
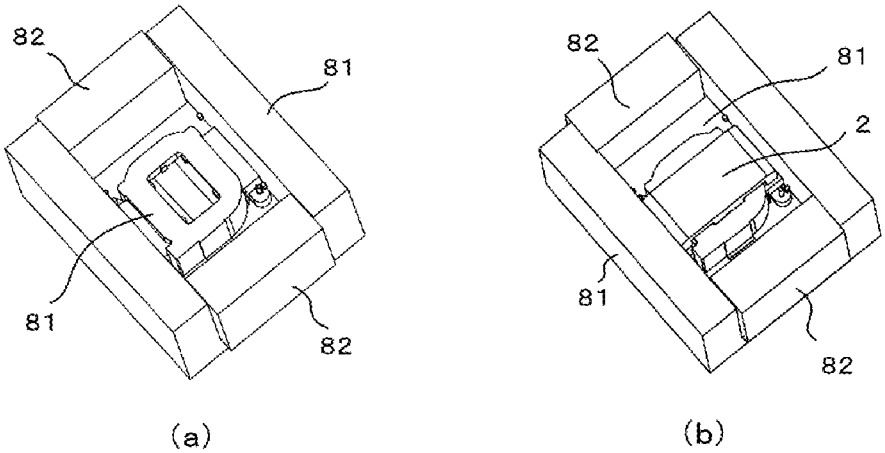
FIG. 8 is a perspective view and a cross-sectional view illustrating first and second steps of a manufacturing method according to the first embodiment.

(1) As illustrated in FIG. 8(*a*), a lower mold 81 of the molding is to mold the lower cover 5 in a shape upside down, and has a bottom provided with a recess along the upper surface shape of the lower cover 5, and right and left side walls. Formed at the bottom is a recess having a deep depth and a narrow width where the resin forming the right and left side walls 53 is applied, and concavity and convexity in which the right and left legs and the middle leg of the lower core 2 enter. Two sliders 82 moving back and forth (Y-direction) between the right and left walls are provided in the space and in the back-and-forward direction held between the right and left walls of the lower mold 81.

(2) As illustrated in FIG. 8(*b*), with the two sliders 82 being opened outwardly relative to the lower mold 81, the lower core 2 is set upside down in the lower mold 81. The lower core 2 is positioned by the legs and the middle leg fitted into the recess provided in the bottom of the lower mold 81.

Figure 9:
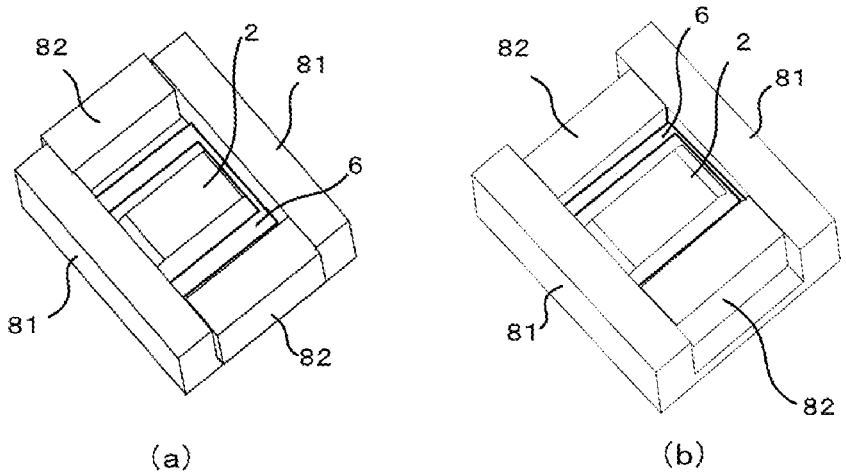
FIG. 9 is a perspective view and a cross-sectional view illustrating third and fourth steps of the manufacturing method according to the first embodiment.

(3) As illustrated in FIG. 9(*a*), the casing 6 is set in the lower mold 81 with the bottom plate 64 facing up. The front wall 62 and rear wall 63 of the casing 6 are placed in the horizontal direction (X-direction), and the lower core 2 is covered from above by the front wall 62 and the rear wall 63.

(4) As illustrated in FIG. 9(*b*), a slider is moved to intimately contact and hold the front wall 62 and rear wall 63 of the casing 6 from the back-and-forward direction, and then the upper opening of the lower mold 81 is closed by an unillustrated upper mold to depress the bottom plate 64 of the casing 6 by the upper mold. At this time, it is preferable to hold one slider, for example, the front slider with a load smaller than the rear slider by utilizing a slider that can control the load, such as a hydraulic slider, a spring slider, and a pneumatic slider. In this way, the casing 6 is positioned in the X-direction by the wall surface of the lower mold 81. The casing 6 is positioned in the Y-direction by being held between the sliders, and is positioned by closing the upper mold. Since the sliders are intimately in contact with the side surface of the casing 6, and the upper mold is intimately in contact with the bottom of the casing 6, no resin is stretched over on the side surface of the casing 6 and the bottom of the casing 6, and the surfaces of the casing 6 are exposed from the resin. Since these surfaces become cooling surfaces, excellent heat dissipation characteristics can be achieved by exposing the metal surface of the casing 6. A part of the side surface of the casing 6 facing the mold wall surface is formed of the resin forming the lower cover 5.

Figure 10:
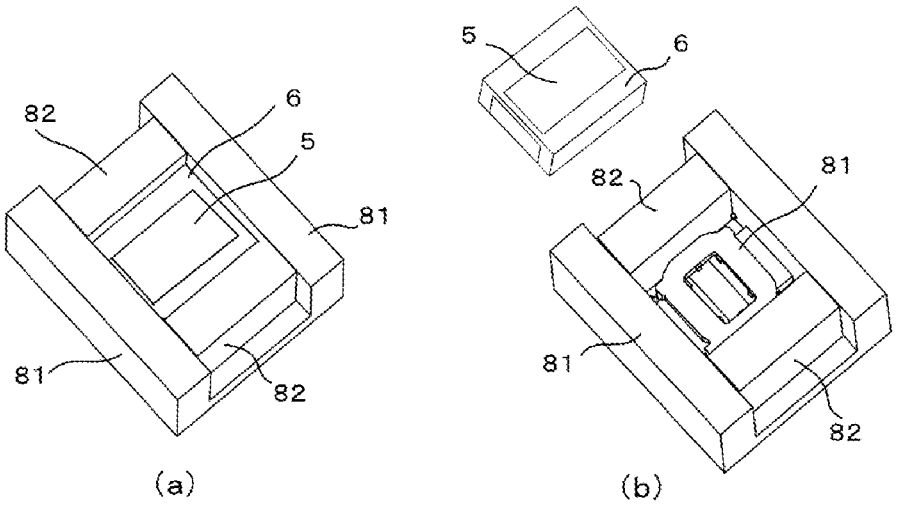
FIG. 10 is a perspective view and a cross-sectional view illustrating fifth and sixth steps of the manufacturing method according to the first embodiment.

(5) As illustrated in FIG. 10(*a*), the resin is injected from an unillustrated gate provided on the upper mold aligned at the substantial center position of the opening 65 of the casing 6, and the lower core 2 and the casing 6 are integrally molded. Since the lower core 2 is depressed toward the lower mold 81 by the injection pressure of the resin, a precise positioning is achieved without positioning in the Z-direction using any mold mechanism. Hence, no opening is formed in the resin portion at the bottom surface side of the casing 6, and insulation of the lower core 2 can be ensured even when the installation surface is metal. Since the resin forming the lower cover 5 also has a thermal conductivity better than air, it is possible to cover the entire rear surface of the lower core 2 by the resin forming the lower cover 5, and the heat dissipation is improved. Since the lower core 2 is depressed toward the lower mold 81 by the injection pressure of the resin, no resin flows in the joining surface of the lower core 2, and the joining surface is exposed from the resin. A trace of the injection gate is left at the substantial center portion of the bottom plate 56 of the lower cover 5 exposed in the opening 65 of the casing 6 is.

(6) As illustrated in FIG. 10(*b*), the injected resin is solidified by cooling to form a lower cover 5, and after the lower cover 5, the lower core 2, and the casing 6 are integrally fastened, the upper mold and the sliders are removed, and then the product is removed from the mold.

1-4. Action and Effect

The effects of the first embodiment employing the above structure are as follows.

(1) Since the lower core 2 and the casing 6 are integrated with each other by insert molding when molding the lower cover 5 by resin, in comparison with conventional technologies in which the lower core covered by the lower cover is placed in an individually prepared casing, a fastening work of the casing and the lower core is unnecessary, simplifying the assembling work of the reactor.

(2) Since the lower core 2, the lower cover 5, and the casing 6 are integrally fastened with each other, at the time of assembling the reactor, the reactor can be assembled by a simple work of inserting the coil 3 and the upper core 1 having the upper cover 4 inside the housing space formed by the casing 6 and the lower cover 5 in sequence.

(3) Since the housing space for the coil 3 and the upper core 1 is formed by the side wall 53 of the lower cover 5 and the front wall 62 and rear wall 63 of the casing 6, it is unnecessary to position the casing 6 formed of metal around the entire circumference of the coil 3. Hence, by the casing 6 formed of metal placed in the vicinity of the outer circumference of the coil 3, the heat produced in the coil 3 is effectively dissipated, and weight reduction by reduction of the casing 6 formed of metal is achieved while ensuring the effect of high cooling efficiency. In this embodiment, as a result of employing the structure in which cooling is performed by both the front wall 62 and rear wall 63 of the casing 6, there is an advantage that the cooling effect is remarkably high. At the portion where the casing 6 is not present, the casing 6 does not generate heat due to the leakage magnetic flux from the annular core, and the reactor loss can be reduced.

(4) In this embodiment, by the shielding effect of the casing 6 formed of aluminum, there is an effect that the reduction of the inductance can be suppressed. That is, according to the conventional technologies, since the side surface of the casing is placed so as to face the yoke portion of the core, the inductance is reduced due to the shielding effect against the magnetic flux leaked from the back surface of the core. According to this embodiment, however, since the bottom plate 64 and the opening 65 of the casing 6 corresponding to the portions facing the yoke portion are the bottom plate 56 of the lower cover 5 formed of resin or the opening where no metal is present, excellent inductance characteristics can be achieved without being adversely affected by the shielding effect of the casing 6.

(5) The side wall 53 of the lower cover 5 formed of resin is positioned on the outer circumference of the annular core formed by the upper core 1 and the lower core 2. Although the lower cover 5 formed of resin has thermal conductivity lower than the casing 6 formed of metal, since the thermal conductivity of the lower cover 5 is better in comparison with the case in which the core and the coil 3 are exposed in the air, even if there is a neat generation from the coil 3 or the core, the heat dissipation from the right and left side walls 53 of the lower cover 5 is still excellent.

(6) Since the opening 65 is provided in the substantially entire area of the bottom plate 64 of the casing 6 and the bottom plate 56 of the lower cover 5 is fitted in this portion, the heat dissipation from the lower surface of the reactor is ensured by the bottom plate 64 of the casing 6 formed of metal. At the same time, since there is no metal component, which generates heat due to the leakage magnetic flux, at the bottom of the reactor, there is no possibility of heat generation by the casing 6 and efficiency reduction of the reactor due to the heat generation of the casing 6. Like the side portion of the reactor, since the resin forming the lower cover 5 has an excellent thermal conductivity compared with air, heat generation by the coil 3 and by the core is also effectively dissipated from the bottom of the reactor.

(7) The height of the side wall 61 of the casing 6 is higher than the upper surface of the coil 3 housed in the casing 6, and the filler resin 7 covers the upper surface; of the coil 3. By this, the coil 3 is entirely covered by the filler resin 7, and is not exposed in the air having the low thermal conductivity, and the heat of the coil 3 is efficiently dissipated through a path, such as from the filler resin 7, via the lower casing 6, and to the casing 6.

2. Second Embodiment

2-1. Structure

A second embodiment will be described with reference to FIGS. 11 to 17. Similar components to those of the first embodiment will be denoted by the same reference numerals, and the description thereof will be omitted. The second embodiment differs from the first embodiment in the following points.

Figure 11:
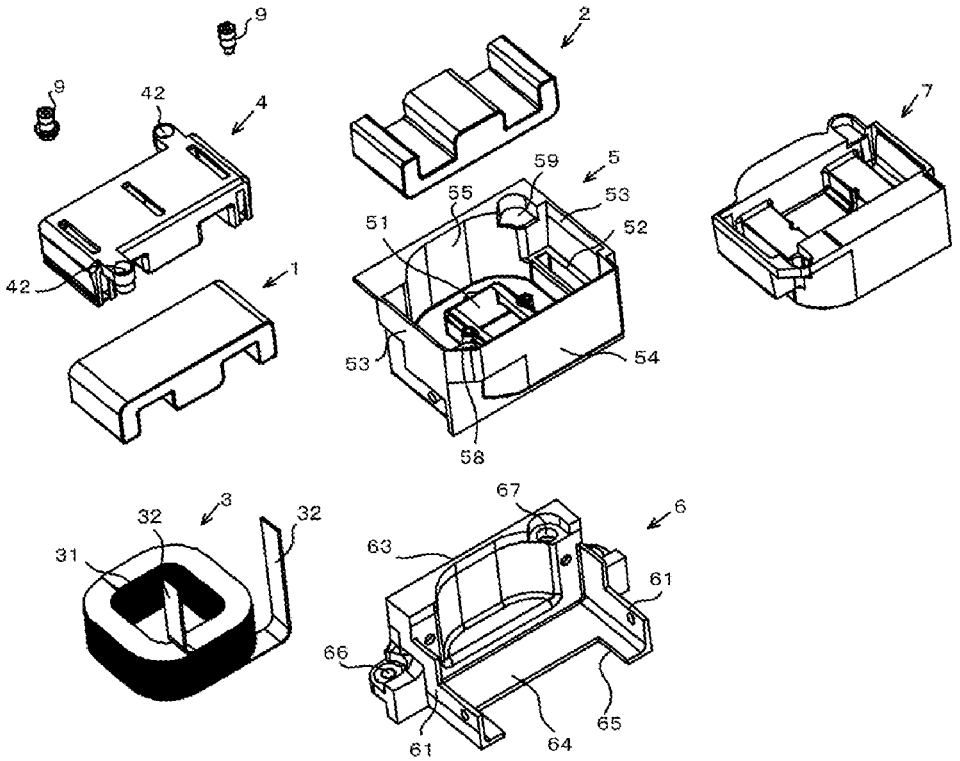
FIG. 11 is an exploded perspective view according to a second embodiment.

As illustrated in FIG. 11 that is an exploded perspective view, the upper cover 4 is provided with two through-holes 42 for fastening the upper core 1 and the upper cover 4 covering the circumference thereof to the lower cover 5. The shaft portion of the screw 9 is inserted into each through-hole 42, and the leading end of the screw 9 is fastened to the screw hole provided in the lower cover 5 and the casing 6, fastening the lower cover 5 and the upper cover 4 with each other at the time of assembling of the reactor.

The lower cover 5 has a rear wall 55 in addition to the right and left side walls 53 and the front wall 54. The portion surrounded by these walls in four directions is defined as the housing space for the coil 3 and the upper core 1. The lower cover 5 is provided with the screw hole 58 to insert the fastening screw 9 of the upper core 1, and a through hole 59 to insert the fastening screw 9 of the upper core 1 likewise.

The casing 6 has no front wall, but has the rear wall 63, the bottom plate 64, and the right and left side walls 61 integrated with and the rear wall 63. The right and left side walls 61 are step-like members that are higher than the rear-wall-63 side and lower than the forehead side of the casing 6. A through hole 66 is provided in the external side of the side wall 61 into which the; shaft portion of the fastening screw 9 is inserted when the reactor is fastened to the installation place. A screw hole 67 is provided in the rear wall 63, and the leading end of a fastening screw 9 of the upper cover 4 inserted in the through hole 59 of the lower cover 5 is screwed into the screw hole 67. The bottom plate 64 is provided with the opening 65 through which the bottom plate 56 of the lower cover 5 is exposed, but the opening 65 according to the second embodiment is formed in a portion of the bottom plate 64 at the front-wall-62 side and has a size of substantially ⅓ of the bottom plate 64, and in parallel with the front wall 62.

In the second embodiment, drawn wires 32 of the coil 3 drawn toward the upper space of the reactor are also illustrated.

The reactor of the second embodiment employing such structure is manufactured by the similar method to that of the first embodiment.

That is, with the lower core 2 and the casing 6 being set in a mold for molding the lower cover 5, the resin is injected in the mold and solidified to form the lower cover 5. Accordingly, the lower core 5 is covered by the lower cover 5, and the lower core 2, the lower cover 5 and the casing 6 are integrally fastened with each other.

Figure 12:
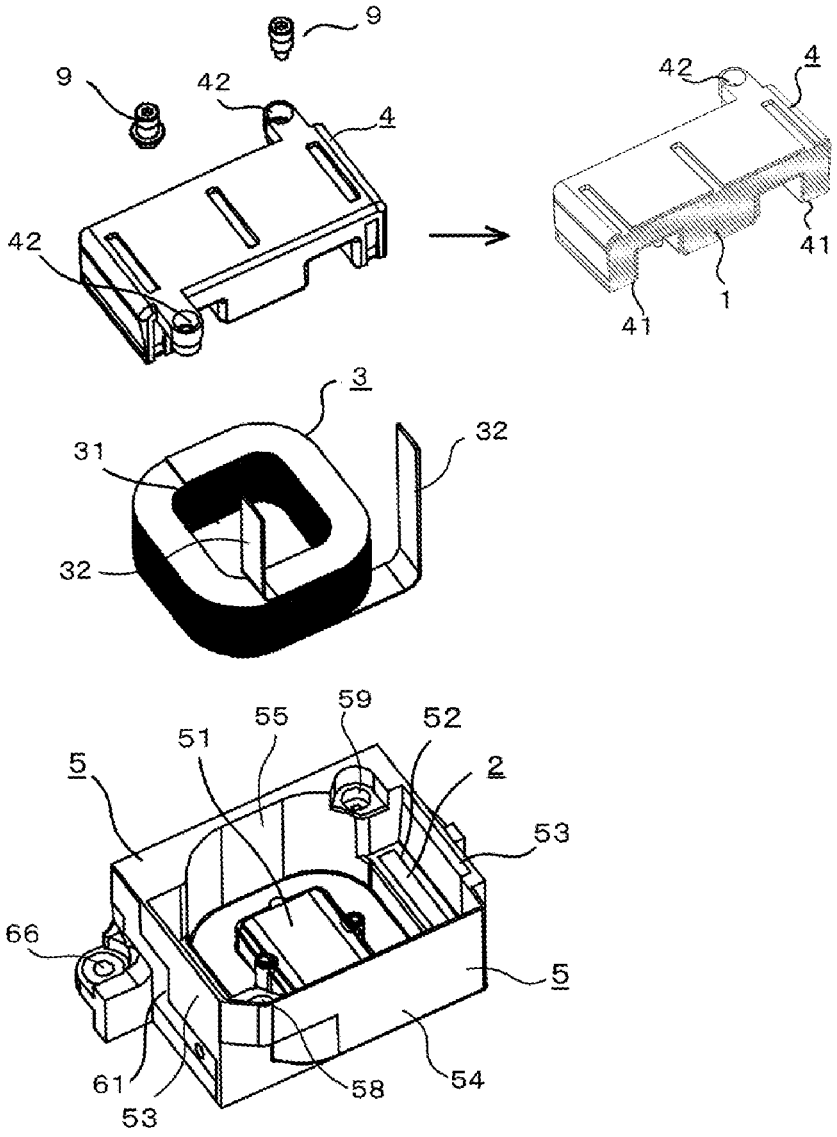
FIG. 12 is an exploded perspective view illustrating a state during the manufacturing according to the second embodiment.
Figure 13:
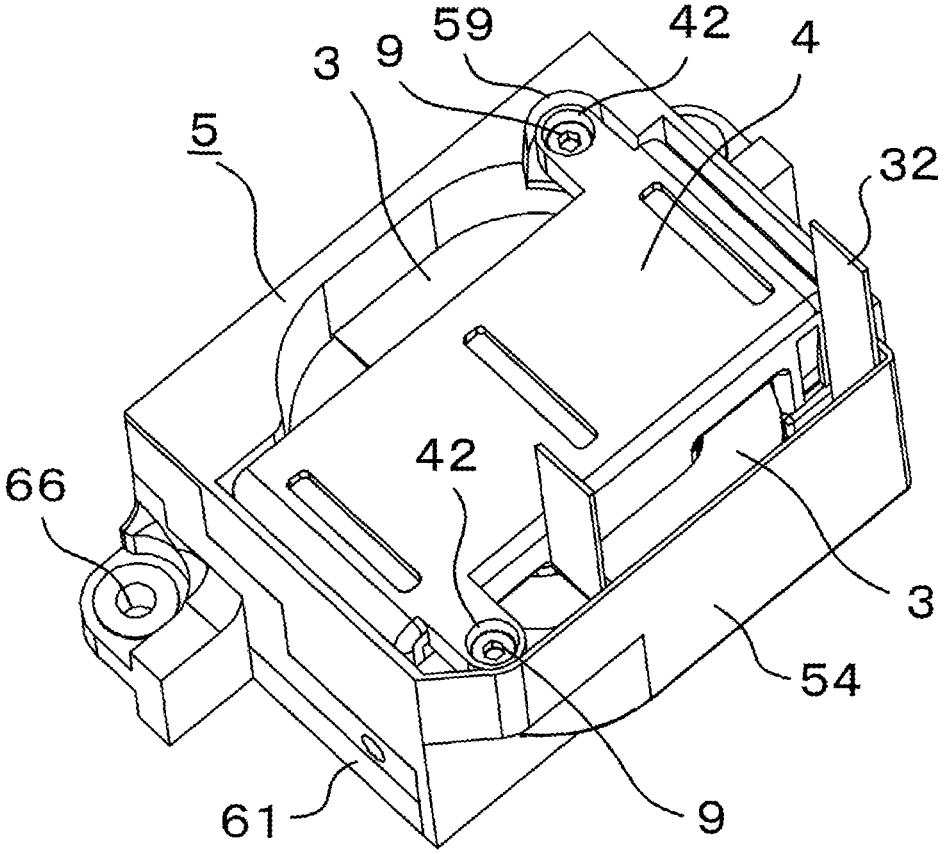
FIG. 13 is a perspective view illustrating a state before a filler resin is filled according to the second embodiment.
Figure 14:
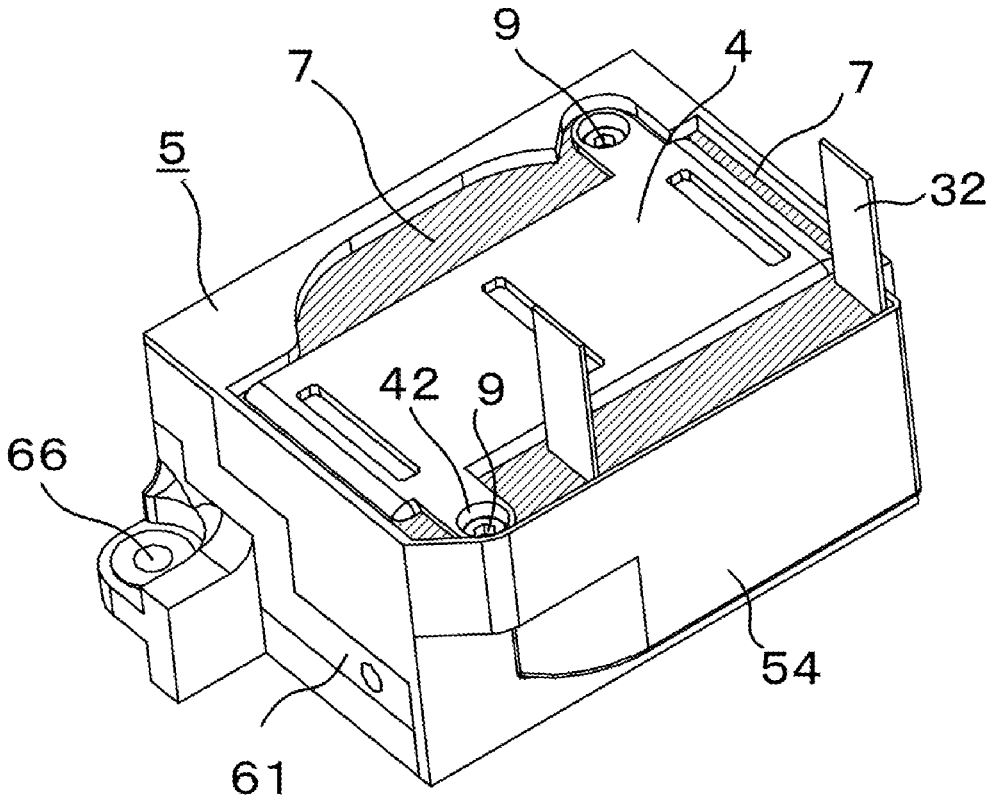
FIG. 14 is a perspective view of a finished state according to the second embodiment.
Figure 15:
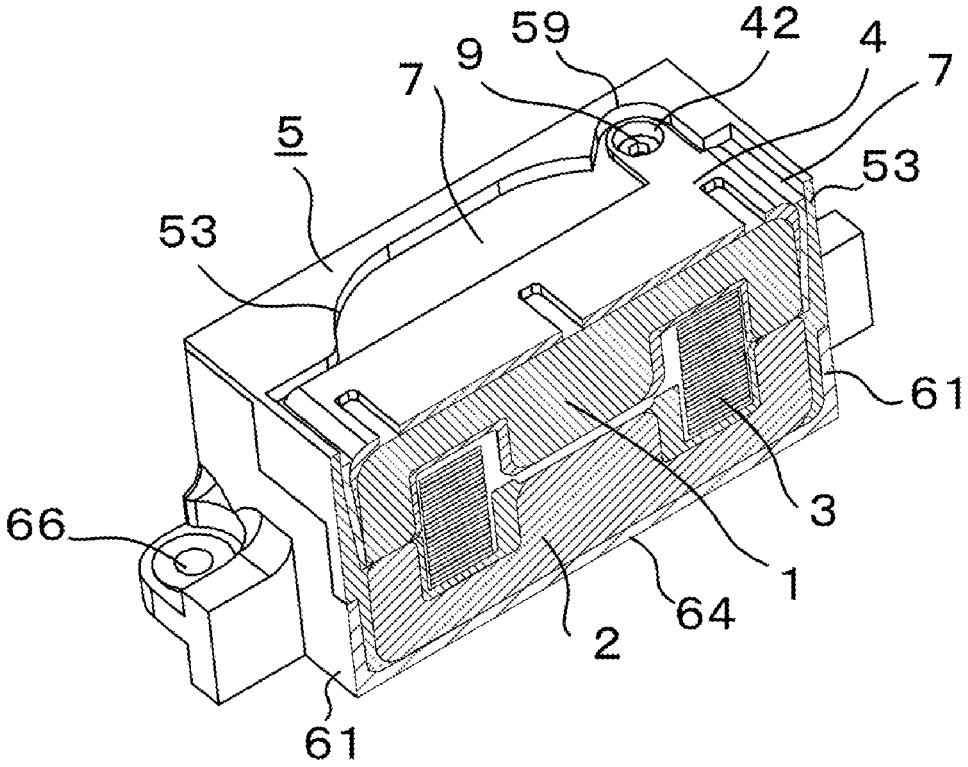
FIG. 15 is a vertical cross-sectional view of the second embodiment viewed from above.
Figure 16:
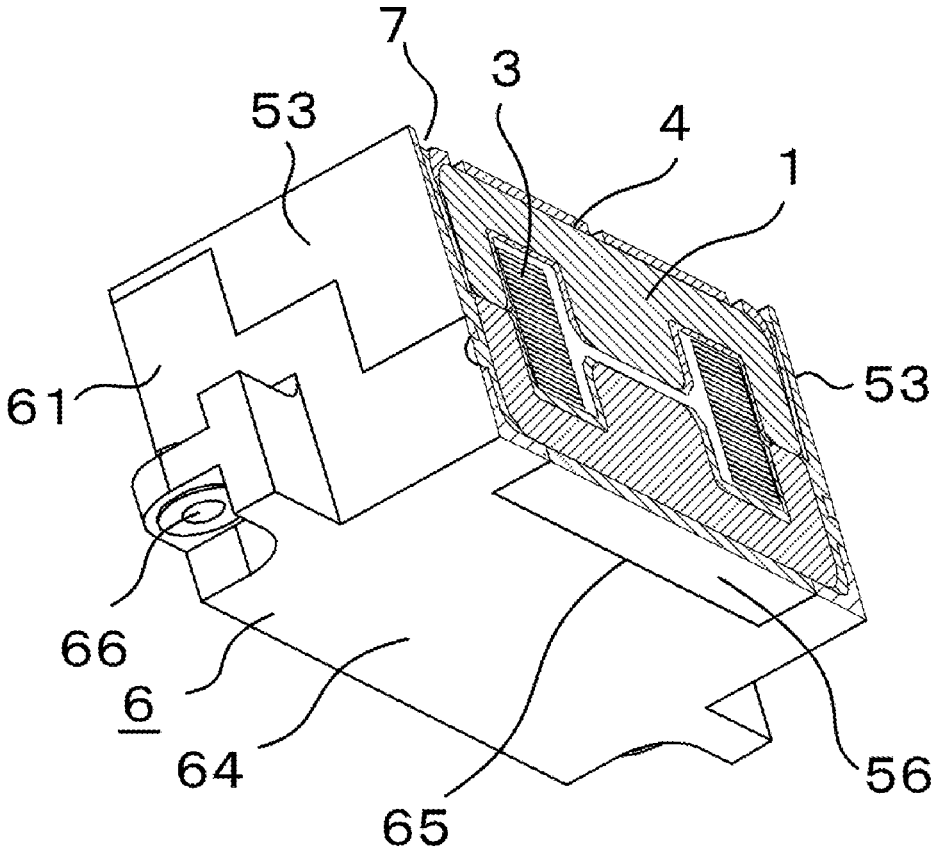
FIG. 16 is a vertical cross-sectional view of the second embodiment viewed from below.
Figure 17:
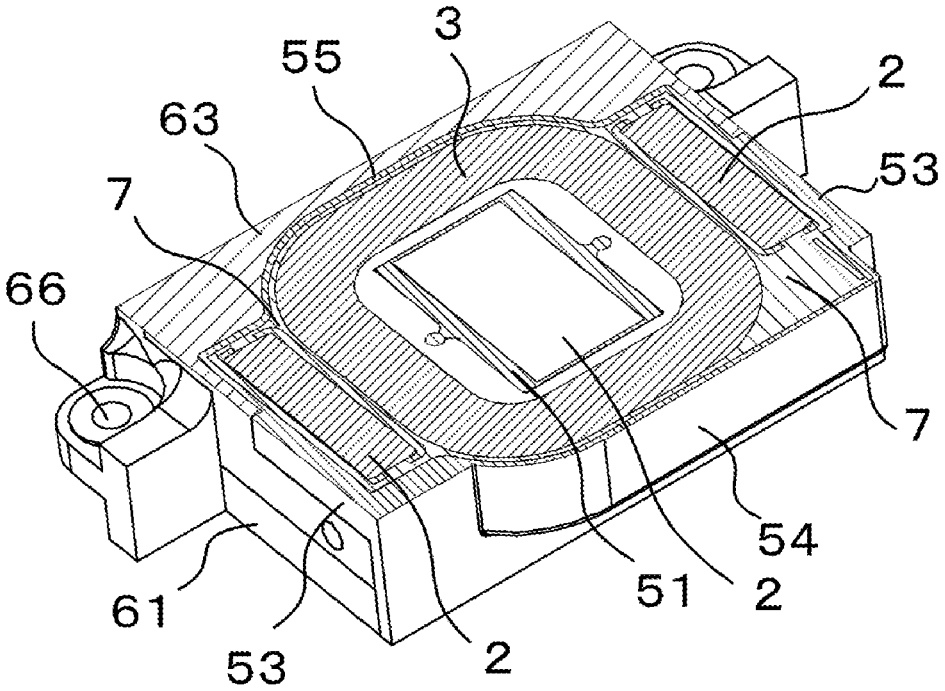
FIG. 17 is a horizontal cross-sectional view of the second embodiment.
Figure 18:
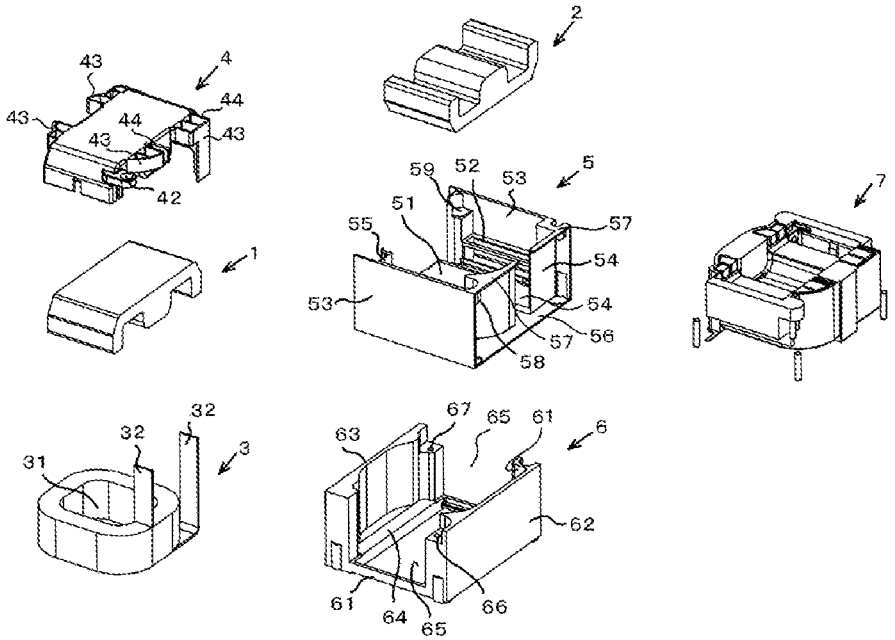
FIG. 18 is an exploded perspective view of a third embodiment.
Figure 19:
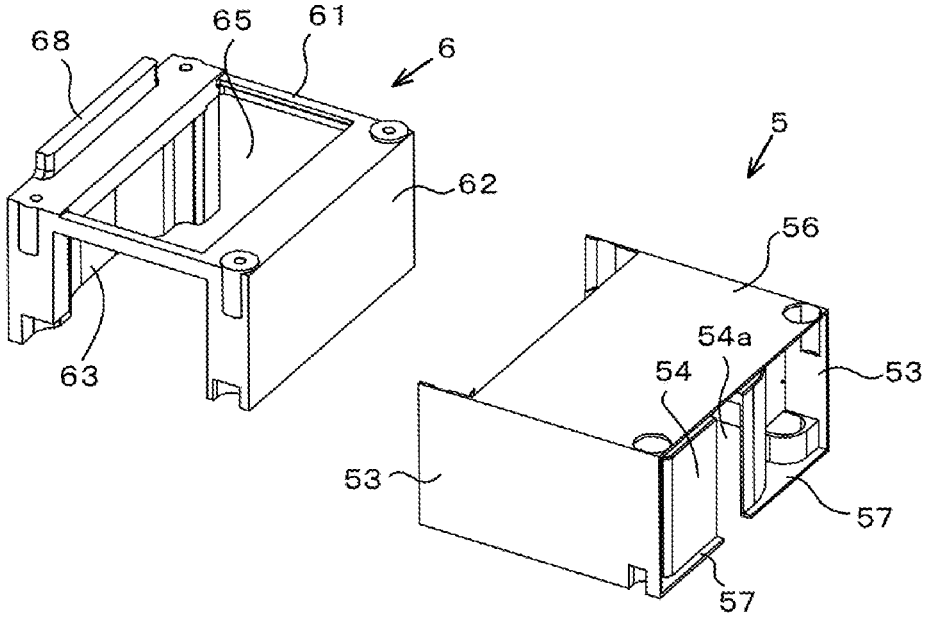
FIG. 19 is an exploded perspective view illustrating the bottom shape of the casing and the lower cover according to the third embodiment.
Figure 20:
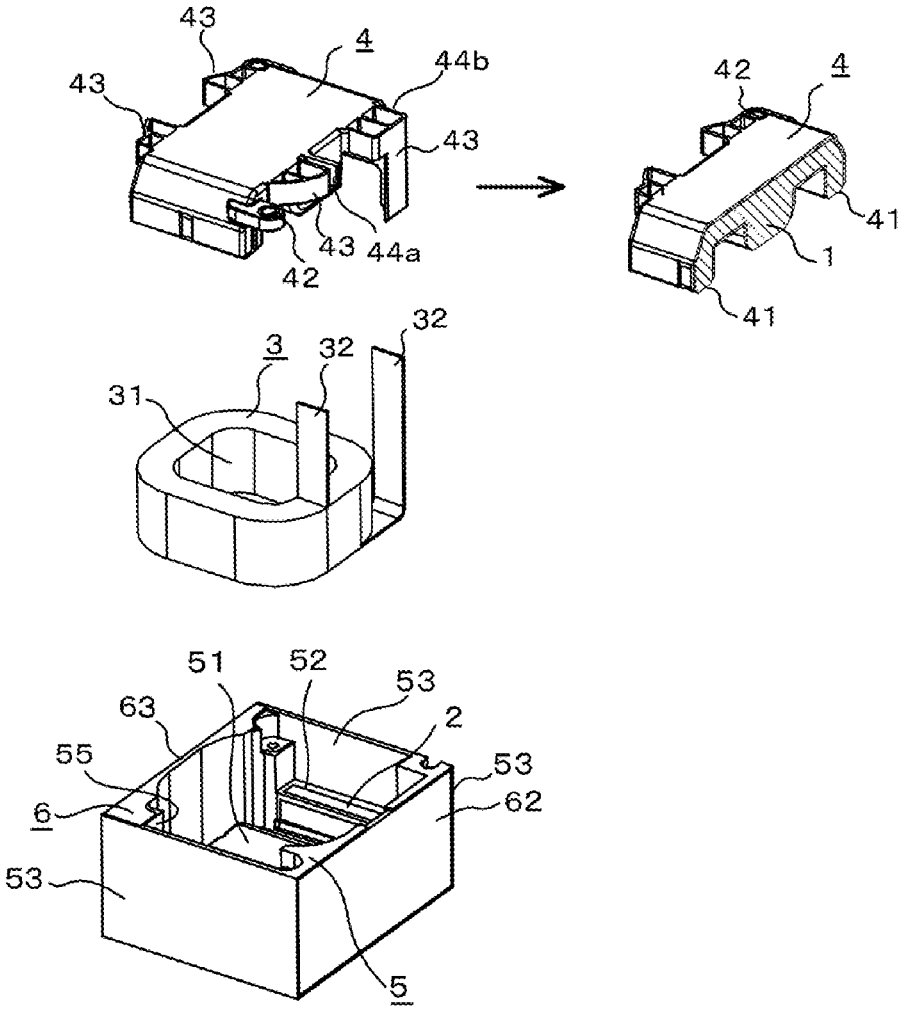
FIG. 20 is an exploded perspective view illustrating a state during the manufacturing of the third embodiment.
Figure 21:
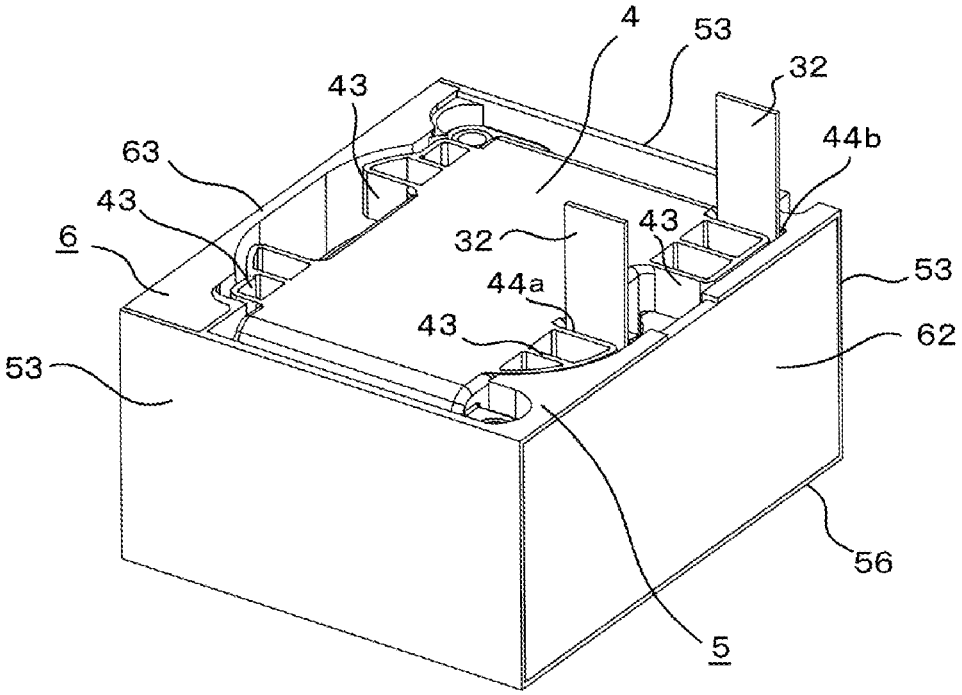
FIG. 21 is a perspective view illustrating a state before a filler resin is filled according to the third embodiment.
Figure 22:
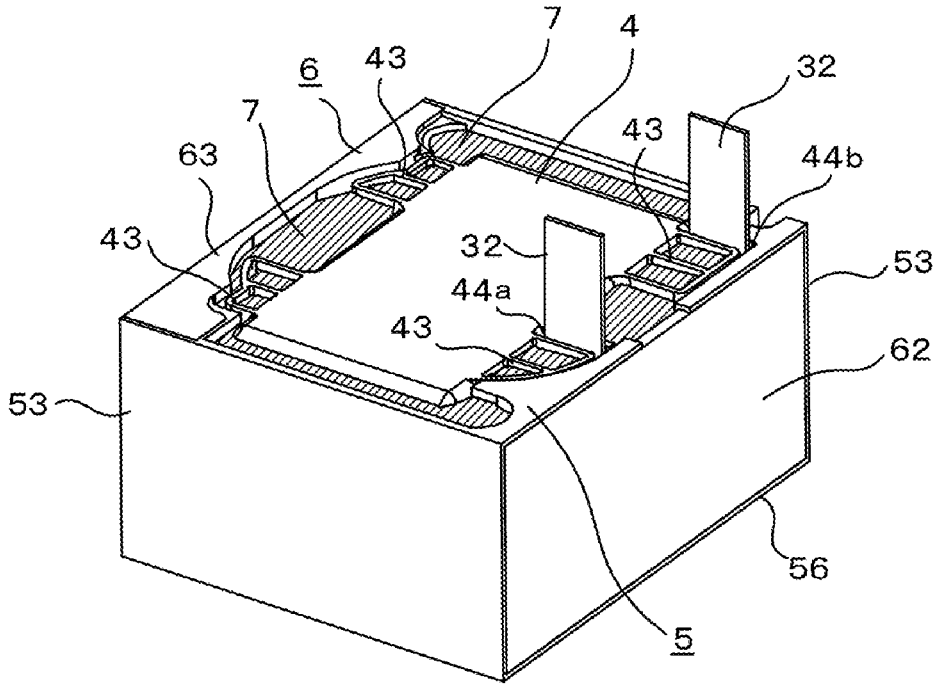
FIG. 22 is a perspective view of a finished state according to the third embodiment.
Figure 23:
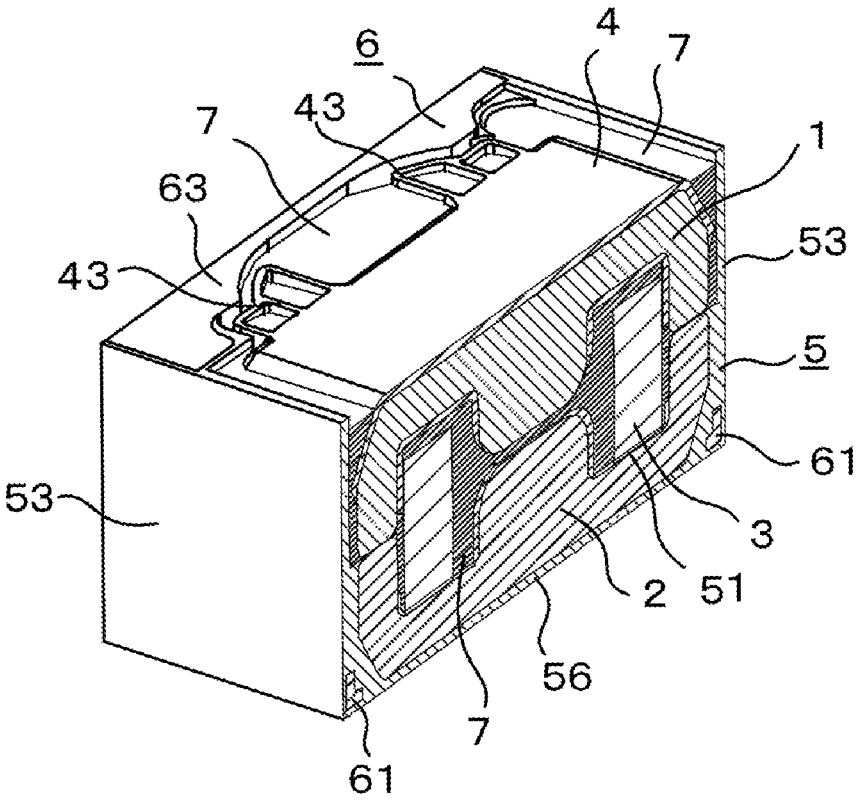
FIG. 23 is a vertical cross-sectional view of the third embodiment viewed from above.
Figure 24:
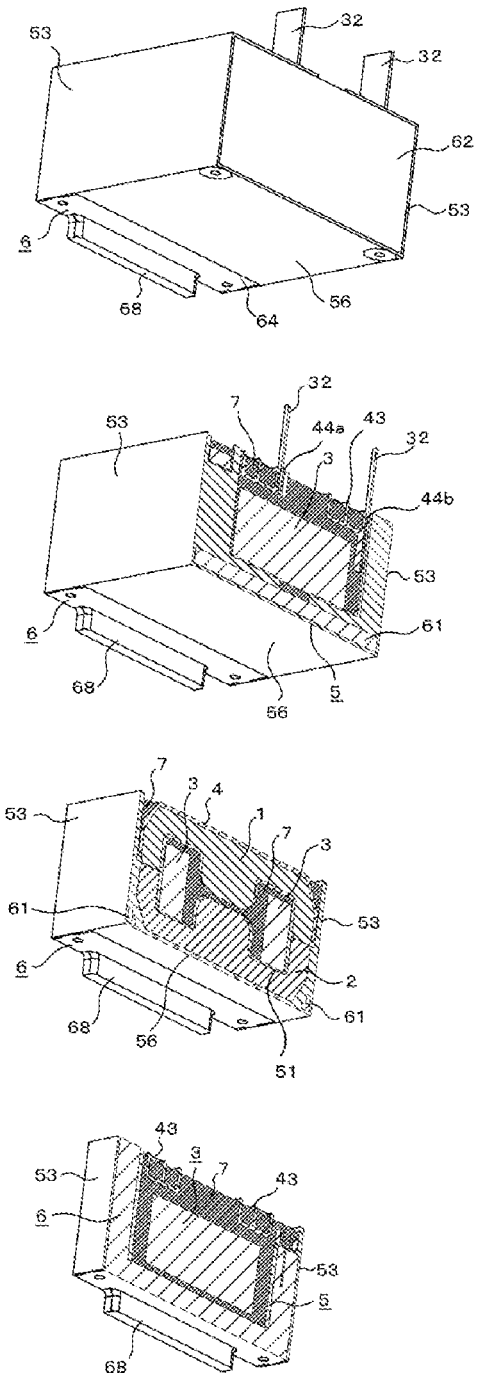
FIG. 24 is a perspective view of the third embodiment viewed from below, and a vertical cross-sectional view of three different locations.
Figure 25:
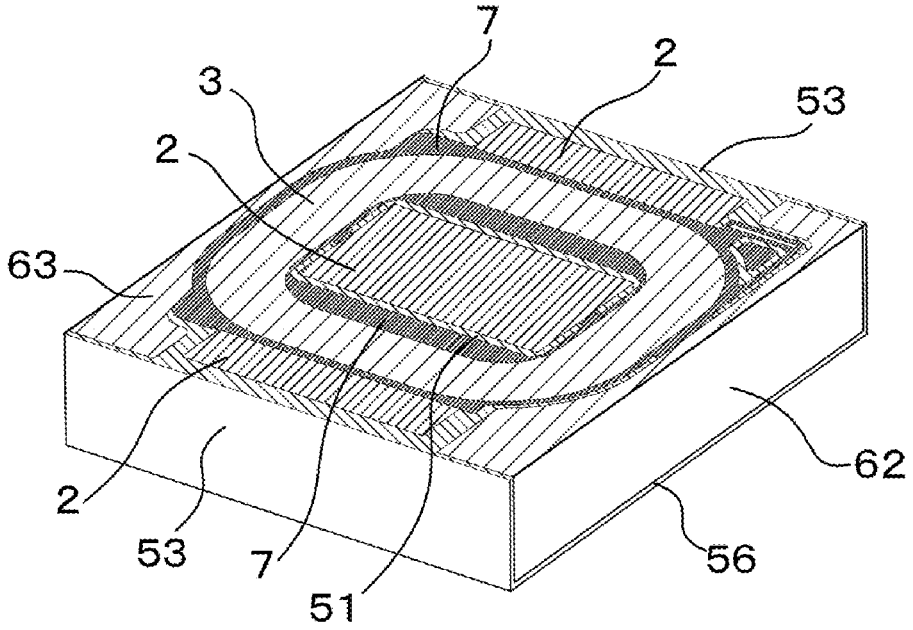
FIG. 25 is a horizontal cross-sectional view of the third embodiment.

Next, as illustrated in FIG. 12, the coil 3 is inserted into the housing space surrounded by the right and left side walls 61, front wall 62, and rear wall 63 of the lower cover 5, and then the upper core 1 covered by the upper cover 4 is placed above the coil 3. In this case, as illustrated in FIG. 13, since a gap is formed between the coil 3 and the circumference of the upper cover 4, and the inner circumference of the lower cover 5, as indicated by hatching in FIG. 14, the filler resin 7 is filled in such gap and solidified to integrally fasten the entire reactor.

2-2. Action and Effect

According to the second embodiment employing such structure, in addition to the similar actions and effects to those of the first embodiment, the following actions and effects are achieved.

(1) The casing 6 formed of metal and the lower cover 5 formed of resin are integrally fastened with each other at the time of the molding process of the lower cover 5, and the upper core 1 is further fastened to the lower cover 5 and the casing 6 by the screws 9, and the strength of the reactor is high. In particular, since each component is mechanically fastened, a bonding of the upper core 1 and the lower core 2 by an adhesive is unnecessary, and the assembling easiness improves, and the costs by what corresponds to the adhesive is reduced.

(2) Since the opening 65 provided in the bottom plate 64 of the casing 6 has an area smaller than that of the first embodiment, heat dissipation from the bottom plate 64 of the casing 6 formed of metal with a high thermal conductivity is efficiently performed. In addition, the magnetic flux that traverses the casing 6 decreases due to the presence of the opening 65, eliminating a heat generation of the casing 6 and reducing the reactor loss.

(3) Since the housing space is seamlessly surrounded by the right, and left, side walls 53, front wall 54, and rear wall 55 of the lower cover 5, even if the precision of the mold for molding the casing 6 is not high and a gap is present between the lower cover 5 and the casing 6, the filler resin 7 injected into the gap between the upper core 1 and outer of the coil 3 does not enter such portion.

3. Third Embodiment

3-1. Structure

A third embodiment will be described with reference to FIGS. 18 to 25. Similar components to those of the first and second embodiments will be denoted by the same reference numerals, and the description thereof will be omitted. The third embodiment differs from the first embodiment in the following points.

Like the first embodiment, the casing 6 is provided with the front wall 62 and the rear wall 63, and the bottom plate 64 is provided only at locations close to the front wall 62 and the rear wall 63, and the majority of the bottom plate 64 is a large opening 65. The side wall 61 has a low height and provided only at a location close to the bottom of the casing 6, and the right and left sides of the casing 6 are also opened widely. The bottom plate 64 of the casing 6 is provided with a protrusion 68 extending in parallel with the rear wall 63. The protrusion 68 is utilized as a positioning member for the casing 6 when the reactor of this embodiment is fastened to the object to which the reactor is attached.

The lower cover 5 has the front wall 54 in which an opening 54*a* extending in the vertical direction is formed at the center portion, and has right and left rear walls 55 provided only at both sides of the lower cover 54 in the vertical direction. An upper surface plate 57 covering the upper surface of the casing 6 is integrally provided on the upper edge of the front wall 54. The lower surface of the side wall 65 of the casing 6 is positioned one step higher than the lower surface of the bottom plate 64, the opening 65 of the bottom plate 64 and the lower surface of the bottom plate 64 are covered by the bottom plate 56 of the lower cover 5, and the lower surface of the bottom plate 64 of the casing 6 and the bottom plate 56 of the lower cover 5 becomes the same surface. The surface of the side wall 61 of the casing 6 and the right and left openings of the casing 6 are covered by the right and left side walls 53 of the lower cover 5, and no side wall 61 is exposed.

Provided at the front and rear portions of the upper cover 4 are four projections 43 which block the gaps between the upper cover 4, and the front wall 62 and rear wall 63 of the casing, and which covers the vicinity of the end surface of the coil 3 at the opening side of the casing 6. Three of the projections 43 are each in a frame shape having the plane in a ¼ arc shape and a closed bottom, and the one of projection 43 is provided at the forehead portion of the upper cover 4, and the two other are provided at the right and left rear portions of the upper cover 4. The remaining projection 43 is in a frame shape having a rectangular shape and the closed bottom, and is provided at one location of the forehead portion of the upper cover 1. A gap 44*a* is provided to pass through the; projection 43 with the ¼ arc shape at the forehead portion in the vertical direction, and one of the drawn wire 32 of the coil 3 passes through this gap 44*a* in the vertical direction. The other drawn wire 32 of the coil 3 passes through a gap 44*b* between the rectangular projection 43 and the side plate 61 of the casing 6 in the vertical direction.

3-2. Action and Effect

According to the third embodiment employing such structure, in addition to the similar actions and effects to those of the first and the second embodiments, the following actions and effects are achieved.

(1) Since the majority of the surface of the casing, that is, the upper surface of the casing 6, the lower surface of the side wall 61, the lower surface of the bottom plate 64, etc., are covered by the lower cover 5 formed of resin, the planar level of portion exposed to the exterior of the reactor can be improved at low costs. In general, when the casing 6 formed of metal is mass-produced, the surface of the casing is usually a casting surface since the casing is formed by die-casting, and a cutting work is necessary to increase the planar level, requiring costs for the cutting work. In this embodiment, by covering the surface of the casing 6 by the lower cover 5 formed of resin, the planar level precision by the mold for the lower cover 5 can be easily improved, and costs for the work on the surface of the casing 6 is unnecessary. In the first and second embodiments, a part of the casing 6 and the opening are covered for the same reason.

(2) Since the protrusion 68 is provided on the bottom plate 64 of the casing 6, the positioning thereof can be performed easily and precisely when the reactor is fastened to the object where the reactor is attached. In addition, the protrusion 68 increases the contact area between the object where the reactor is attached and the casing 6, and heat dissipation from the casing 6 formed of metal to the object where the reactor is attached is also excellent.

(3) Since the upper cover 4 is provided with the projections 43, the amount of resin 7 to be filled between the casing 6 and the upper cover 4 can be reduced by what corresponds to the projections 43. In addition, the drawn wires 32 of the coil 3 can be precisely positioned by the gaps 44*a* and 44*b* provided in the projections 43.

4. Other Embodiments

The present disclosure is not limited to the above embodiments, and includes the following other embodiments.

(1) It is appropriate as long as the casing have any of the right and left side walls, the front wall, and the rear wall, and the bottom plate provided with an opening, and a housing space for the coil and the upper core can be formed by providing a wall on the lower casing at a location where there is no wall.

(2) The location of the opening provided in the casing may be at least in the portion of the bottom plate, but it is preferable to be in position and size that can reduce the reactor loss by the casing formed of metal.

(3) A gap may be provided between the joining surface of the upper core and the lower core, and in this case, the upper cover and the lower cover may cover the entire circumference of the upper core and the lower core without forming an opening in the opposing surfaces of the upper core and the lower core. In the case there is no problem in, for example, insulation performance, without covering the entire upper core or lower core by the upper cover or the lower cover, the surface of the core may be exposed, and this portion may be covered by the filler resin.

(4) The upper core and the lower core are not limited to an E-shaped core, and cores in other shapes, such as a C-shaped core and a U-shaped core having no middle leg are also applicable. As an upper core, a single I-shape core may be applied, and an E-shape core, C-shaped core, or a U-shaped core may be combined therewith. In addition, the coil is not limited to the single coil attached to the middle leg, and coils may be attached to the right and left legs of an annular core.

What is claimed is:

1. A reactor comprising:

an annular core comprising an upper core and a lower core, and has upper and lower yokes extending in a horizontal direction and a leg extending in a vertical direction;

a coil attached to the leg of the annular core with a winding axis thereof aligned in a vertical direction;

an upper cover formed of resin and fastened so as to cover at least a part of a surface of the upper core;

a lower cover formed of resin and fastened so as to cover at least a part of a surface of the lower core;

a casing formed of metal, comprising a bottom plate having an opening, and a side wall provided integrally with the bottom plate, wherein the lower core, the coil, and the upper core are housed in the casing, and wherein the casing is fastened to the lower cover with the opening covered by a part of the lower cover; and a filler resin filled in a gap between a circumference of the annular core and the coil, and the side wall of the casing or a side wall of the lower cover.

2. The reactor according to claim 1, wherein:

an opening is provided in the side wall of the casing;

a side wall that blocks the opening of the casing is provided on the lower cover; and the filler resin is filled in the gap between the circumference of the annular core and the coil, and the side wall of the casing and the side wall of the lower cover.

3. The reactor according to claim 1, wherein:

a height of the side wall of the casing is higher than an upper surface of the coil housed in the casing; and the filler resin covers the upper surface of the coil.

4. The reactor according to claim 1, wherein:

the casing comprises a front wall and a rear wall;

the lower cover comprises right and left side walls; and a portion surrounded by the walls is a housing space for the upper core and the coil.

5. The reactor according to claim 1, wherein:

the lower cover comprises right and left side walls, a front wall, and a rear wall; and a portion surrounded by the walls is a housing space for the upper core and the coil.

6. The reactor according to claim 1, wherein:

the casing is provided with an opening in a part of a wall; and the lower cover covers the opening.

7. The reactor according to claim 1, wherein at least one surface of an upper surface, the side wall, the front wall, the rear wall, and the bottom plate is covered by the lower cover.

8. The reactor according to claim 1, wherein the upper cover comprises a projection located at a gap between the upper cover and the casing.

9. The reactor according to claim 1, wherein the casing comprises a projection for positioning on a bottom.

10. The reactor according to claim 1, wherein the upper core is fastened to the lower cover and the casing by a screw.

11. The reactor according to claim 1, wherein:

the upper core and the lower core are each formed of an E-shaped core; and the coil is attached to a middle leg of the E-shaped core.

12. The reactor according to claim 1, wherein, at a location facing with the upper yoke of the annular core and the lower yoke of the annular core, the opening provided in the casing and a resin forming the upper cover or the lower cover are provided.

* * * * *